US005102769A

United States Patent [19]

Creatura

[11] Patent Number: 5,102,769

[45] Date of Patent: Apr. 7, 1992

[54] SOLUTION COATED CARRIER PARTICLES

[75] Inventor: John A. Creatura, Ontario, N.Y.

[73] Assignee: Xerox Corporation, Stamford, Conn.

[21] Appl. No.: 654,129

[22] Filed: Feb. 4, 1991

[51] Int. Cl.[5] ..... G03G 9/00; G03G 5/00

[52] U.S. Cl. ..... 430/137; 430/109; 430/110

[58] Field of Search ..... 430/137, 109, 110

[56] References Cited

U.S. PATENT DOCUMENTS

| | | | |
|---|---|---|---|
| 3,778,262 | 12/1973 | Queener et al. | 96/1 R |
| 3,798,167 | 3/1974 | Kukla et al. | 252/62.1 |
| 3,850,676 | 11/1974 | Madrid et al. | 117/100 A |
| 3,873,355 | 3/1975 | Queener et al. | 117/201 |
| 3,873,356 | 3/1975 | Queener et al. | 117/201 |
| 4,007,293 | 2/1977 | Mincer et al. | 427/19 |
| 4,233,387 | 11/1980 | Mammino et al. | 430/137 |
| 4,297,427 | 10/1981 | Williams et al. | 430/108 |
| 4,331,756 | 5/1982 | Mayer et al. | 430/108 |
| 4,434,220 | 2/1984 | Abbott et al. | 430/108 |
| 4,503,136 | 3/1985 | Hara et al. | 430/106.6 |
| 4,725,521 | 2/1988 | Shigeta et al. | 430/108 |
| 4,935,326 | 6/1990 | Creatura et al. | 430/108 |
| 4,937,166 | 6/1990 | Creatura et al. | 430/108 |
| 4,963,455 | 10/1990 | Laing et al. | 430/106.6 |

*Primary Examiner*—Marion E. McCamish
*Assistant Examiner*—S. Rosasco
*Attorney, Agent, or Firm*—E. O. Palazzo

[57] ABSTRACT

A process for the preparation of carrier particles with substantially stable conductivity parameters which comprises providing a carrier core and applying thereto from a solution mixture thereof a mixture of polymers not in close proximity thereto in the triboelectric series.

29 Claims, No Drawings

SOLUTION COATED CARRIER PARTICLES

BACKGROUND OF THE INVENTION

This invention is generally directed to developer compositions, and more specifically, the present invention relates to developer compositions with coated carrier particles prepared by a solution process. In one embodiment of the present invention, the carrier particles are comprised of a core with coating thereover generated from a solution mixture of polymers that are not in close proximity thereto in the triboelectric series. In another aspect of the present invention, the carrier particles are prepared by a solution coating process wherein a mixture of two polymers, at least one, and preferably one, of which is substantially soluble in the solvent selected, are applied to the carrier core enabling insulating particles with relatively constant conductivity parameters; and also wherein the triboelectric charge, either positive or negative on the carrier can vary significantly depending on the coatings selected. Developer compositions comprised of the carrier particles prepared by the solution coating process of the present invention are useful in electrostatographic or electrophotographic imaging systems, especially xerographic imaging processes. Additionally, developer compositions comprised of substantially insulating carrier particles prepared in accordance with the process of the present invention are useful in imaging methods wherein relatively constant conductivity parameters are desired. Furthermore, in the aforementioned imaging processes the triboelectric charge, and/or the conductivity of the carrier particles can be preselected depending on the polymer composition applied to the carrier core.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith as it is these values that can enable continued constant developed images of high quality and excellent resolution.

In a patentability search report, the following United States Patents were recited: U.S. Pat. No. 4,331,756 which discloses that a carrier core can be coated with a solution containing a mixture of butadiene/acrylonitrile rubber and polyurethane, and also see column 8, lines 1 to 7, and column 5, lines 14 to 30; U.S. Pat. Nos. 3,778,262; 3,873,355 and 3,873,356 wherein there is indicated that the very negative tribo that would result from a carrier coated with PTFE is raised to a more positive tribo by mixing another type of resin with the PTFE and solution coating the mixed resins on the carrier core, and note as indicated in the Abstract of the Disclosure that the carrier core is coated with a continuous film of a fluoropolymer and a modifying resin, see the U.S. Pat. No. 3,778,262 patent and also note Examples 1 and 2 in columns 5 and 6; and U.S. Pat. Nos. 4,937,166 and 4,935,326 wherein there are illustrated carrier compositions comprised of a core with a coating thereover comprised of a mixture of a first and second polymer that are not in close proximity thereto in the triboelectric series, which coatings are applied by a dry coating process, reference the '166 patent, and a developer containing a toner with a suspension polymerized styrene butadiene and other components in a carrier with a coating, which carrier is similar to the carrier as illustrated in the '166 patent. The disclosures of each of the aforementioned patents are totally incorporated herein by reference.

Carrier particles for use in the development of electrostatic latent images are described in many patents including, for example, U.S. Pat. No. 3,590,000. These carrier particles may be comprised of various cores, including steel, with a coating thereover of fluoropolymers, and terpolymers of styrene, methacrylate, and silane compounds. Efforts have focused on the attainment of coatings for carrier particles for the purpose of improving development quality, and also to permit particles that can be recycled, and that do not adversely effect the imaging member in any substantial manner. A number of the present commercial carrier coatings can deteriorate rapidly, especially when selected for a continuous xerographic process where the entire coating may separate from the carrier core in the form of chips or flakes, and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There are also illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there are disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes enabling the thermoplastic resin particles to melt and fuse on the carrier core. While the developer and carrier particles prepared in accordance with the process of this patent, the disclosure of which has been totally incorporated herein by reference, are suitable for their intended purposes, the conductivity values of the resulting particles are not constant in all instances, for example, when a change in carrier coating weight is accomplished to achieve a modification of the triboelectric charging characteristics; and further with regard to the'387 patent, in many situations carrier and developer mixtures with only specific triboelectric charging values can be generated when certain conductivity values or characteristics are contemplated. With the invention of the present application, the conductivity of the resulting carrier particles can be substantially constant, and moreover the triboelectric values can be selected to vary significantly, for example, from less than −15 microcoulombs per gram to greater than −70 microcoulombs per gram, or from less than a positive 15 microcoulombs per gram to greater than a positive 70 microcoulombs per gram depending, for example, on the carrier core and polymer mixture selected for affecting the coating process.

There are illustrated in U.S. Pat. No. 4,937,166 and 4,935,326, the disclosures of which are totally incorporated herein by reference, carrier particles with, for example, a mixture of coatings, such as two coatings not in close proximity in the triboelectric series to enable control of the conductivity thereof independent of the triboelectric charging values for example. The aforementioned carriers according to the aforementioned patents are prepared by dry coating processes. Advantages associated with the solution coated carriers of the present invention as compared to the dry coated carriers of the '166 and 326 patents include independence from particle size constraint, that is for example the polymers selected for the aforementioned dry coating can be of a small particle size, for example about 1 micron in average diameter, to enable the polymers to effectively fuse to the core, a greater variety of polymers are available for solution coatings enabling a more complete control of the carrier characteristics, and the like.

It is known that carriers obtained by applying a single insulating resinous coating to porous metallic carrier cores using solution coating techniques can be undesirable from many viewpoints. For example, the coating material may reside in the pores of the carrier cores, rather than at the surfaces thereof; and therefore is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further these processes can result in low product yields. When resin coated carrier particles are prepared by powder coating processes, the majority of the coating materials are fused to the carrier surface thereby reducing the number of toner impaction sites on the carrier material. Additionally, there can be achieved with the dry coating process independent of one another desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics.

Other patents that may be of interest include U.S. Pat. No. 3,939,086, which teaches steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; and 4,434,220.

There can be formulated in accordance with the invention of the present application developers with conductivities of from about $10^{-6}$ mho $(cm)^{-1}$ to $10^{-17}$ mho $(cm)^{-1}$ as determined in a magnetic brush conducting cell, and triboelectric charging values of from about a positive or negative 8 to 80 microcoulombs per gram on the carrier particles as determined by the known Faraday Cage technique. Thus, the developers of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by retaining the polymer ratio coating constant and modifying the coating weight for the carrier particles.

SUMMARY OF THE INVENTION

It is a feature of the present invention to provide toner and developer compositions with carrier particles containing a polymer mixture coating.

In another feature of the present invention there are provided solution coating processes for generating carrier particles of substantially constant conductivity parameters.

In yet another feature of the present invention there are provided solution coating processes for generating carrier particles of substantially constant conductivity parameters, and a wide range of preselected triboelectric charging values.

In yet a further feature of the present invention there are provided carrier particles comprised of a coating with a mixture of polymers that are not in close proximity, that is for example a mixture of polymers from different positions in the triboelectric series, and wherein the polymers are applied from a solution mixture, and wherein one polymer is soluble therein.

Further, in an additional feature of the present invention there are provided carrier particles comprised of a core with a coating thereover generated from a solution mixture of polymers wherein the triboelectric charging values are from about a positive, with a mixture of coatings of, for example, polymethylmethacrylate and polystyrene, or negative with a mixture of coatings of, for example, polyvinylidene fluoride and polymethylmethacrylate 10 microcoulombs to about 70 microcoulombs per gram at the same coating weight.

In another object of the present invention there are provided methods for the development of electrostatic latent images wherein the developer mixture comprises carrier particles with a coating thereover consisting of a mixture of polymers that are not in close proximity in the triboelectric series.

Also, in another feature of the present invention there are provided positively charged toner compositions, or negatively charged toner compositions having incorporated therein carrier particles with a coating thereover obtained from a solution mixture of polymers.

These and other features of the present invention can be accomplished by providing developer compositions comprised of toner particles, and carrier particles wherein the coating thereover is comprised of a mixture of polymers obtained from a solution thereof. In one embodiment the carrier particles selected can be prepared by mixing low density porous magnetic, or magnetically attractable metal core carrier particles with from, for example, between about 0.05 percent and about 3 percent by weight, based on the weight of the coated carrier particles, of a solution mixture of polymers present in a solvent until adherence thereof to the carrier core. The polymers can be applied to the carrier core by, for example, known solution coating techniques, fluidized bed coating, immersion, coating bar coating, spray coating, and the like, followed by evaporation for the purposes of removing the solution solvent. Usually two polymers are selected, one of which is soluble in the solvent selected for solution formation, however, it is believed that up to, for example, about 10 polymers may be utilized.

In a specific embodiment of the present invention, there are provided carrier particles comprised of a core with a coating thereover comprised of a mixture of a first polymer component and a second polymer component, which are not in close proximity in the triboelectric series, and wherein the polymers are applied to the carrier from a solution comprised of solvent and polymer coatings, preferably two, as indicated herein; thereafter drying by heating to remove the solvent; and cooling the coated carrier particles obtained followed by screening primarily for the purpose of removing any formed agglomerates. The aforementioned carrier compositions can be comprised of known core materials including iron with a polymer coating mixture thereover. Subsequently, developer compositions of the present invention can be generated by admixing the aforementioned carrier particles with a toner composition comprised of resin particles and pigment particles.

Various suitable solid core carrier materials can be selected, including those illustrated in the prior art, such as the U.S. patents mentioned herein. Characteristic core properties include those that will enable the toner particles to acquire a positive charge or a negative charge; and carrier cores that will permit desirable flow properties in the developer reservoir present in the xerographic imaging apparatus. Also of value with regard to the carrier core properties are, for example, suitable magnetic characteristics that will permit magnetic brush formation in mag brush development processes; and also wherein the carrier cores possess desirable mechanical aging characteristics. Examples of carrier cores that can be selected for the process of the present invention include iron, steel, ferrites, including semiconductive ferrites, reference U.S. Ser. No. 572,207 (D/90176), the disclosure of which is totally incorporated herein by reference, magnetites, nickel, and mixtures thereof. Preferred carrier cores include ferrites, and sponge iron, or steel grit with an average particle size diameter of from between about 30 microns to about 200 microns.

Illustrative examples of known polymer coatings selected for the carrier particles of the present invention are illustrated in a number of patents, such as U.S. Pat. No. 3,923,503, the disclosure of which is totally incorporated herein by reference. Specific examples of coatings include natural and synthetic resins, such as caoutchouc, colophony, copal, dammer, dragons blood, jalep, storax, mixtures thereof, and the like. Typical synthetic resins are polyolefins, such as polypropylene, polyethylene, halogenated polyolefins, chlorinated polyethylene, polyethylene, poilyvinyls, and polyvinylidenes, such as polystyrene, polymethylstyrene, polyvinylbutyral, polyvinylchloride, polyvinylidene fluoride, polytetrafluoroethylene, polytrichlorofluoroethylene; polyesters; polyurethanes; polysulfides; polycarbonates; mixtures thereof; and the like. Known coating techniques can be utilized as indicated herein and, for example, U.S. Pat. No. 2,618,551, the disclosure of which is totally incorporated herein by reference. The polymer coating can be comprised of from about 99 to about 1 weight percent of a first polymer, and from about 1 to about 99 weight percent of a second polymer, and preferably from about 40 to about 60 and about 60 to about 40, respectively, and wherein the coating weight can be, for example, from about 0.05 to about 2 weight percent of polymethylmethacrylate and copolyethylenevinylacetate; copolyvinylidenefluoride tetrafluoroethylene and polyethylene; polymethylmethacrylate and copolyethylene vinylacetate; and polymethylmethacrylate and polyvinylidenefluoride. Other related polymer mixtures not specifically mentioned herein may be selected, including for example polystyrene and tetrafluoroethylene; polyethylene and polyvinyl chloride; polyvinyl acetate and tetrafluoroethylene; polyvinyl acetate and polyvinyl chloride; polyvinyl acetate and polystyrene; polystyrene and polyvinylchloride; styrene methylmethacrylate organosilane terpolymers and polyvinylchloride; polymethylmethacrylate and polyvinylchloride; and the like providing that one of the polymers selected is soluble in the solvent utilized to form the solution mixture.

The solution selected can be comprised of the polymer coating mixture and a solvent which will dissolve at least one of the polymer coatings selected, such as organic solvents like methylethylketone, acetone, toluene, ethyl acetate, dimethylformamide, dimethylacetamide, dimethyl-2-pyrrolidone, triethylphosphate, and the like. Preferably two polymers are selected wherein one of the polymers is soluble in the solvent. Typical concentrations of polymer mixture present in the solvent are from about 5 to about 25 weight percent, and preferably from about 10 to about 15 weight percent.

With further reference to the polymer coating mixture, by close proximity as used herein refers, for example, that the choice of the polymers selected are dictated by their position in the triboelectric series, reference U.S. Pat. No. 4,937,166, therefore for example, one may select a first polymer with a significantly lower triboelectric charging value than the second polymer. For example, the triboelectric charge of a steel carrier core with a polyvinylidenefluoride coating is about −75 microcoulombs per gram. However, the same carrier, with the exception that there is selected a coating of polymethacrylate, has a triboelectric charging value of about −12 microcoulombs per gram. More specifically, not in close proximity refers to first and second polymers that are at different electronic work function values, that is they are not at the same electronic work function value; and further, the first and second polymers are comprised of different components. Additionally, the difference in electronic work functions between the first and second polymer is at least 0.2 electron volt, and preferably is about 2 electron volts; and moreover, it is known that the triboelectric series corresponds to the known electronic work function series for polymers, reference "Electrical Properties of Polymers", Seanor, D.A., Chapter 17, *Polymer Science*, A. D. Jenkins, Editor, North Holland Publishing (1972), the disclosure of which is totally incorporated herein by reference.

The percentage of each polymer present in the carrier coating mixture can vary depending on the specific components selected, the coating weight and the properties desired. Generally, the coated polymer mixtures used contain from about 1 to about 99 percent of the first polymer, and from about 99 to about 1 percent by weight of the second polymer. Preferably, there are selected two polymers with from about 40 to 65 percent by weight of the first polymer, and from about 60 to 35 percent by weight of a second polymer. In one embodiment of the present invention, when a high carrier triboelectric charging value is desired, that is, exceeding −50 microcoulombs per gram, there is selected from about 90 percent by weight of the first polymer such as polyvinylidene fluoride, and 10 percent by weight of the second polymer such as polymethylacrylate. In contrast, when a lower carrier triboelectric charging value is desired, less than about −20 microcoulombs per gram, there can be selected from about 10 percent by weight of the first polymer, and 90 percent by weight of the second polymer. The coating ratio amount can be adjusted to control or preselect the tribo of the carrier, and the carrier polymer coating weight can be adjusted to control or preselect the carrier conductivity.

Also, these results, in accordance with an embodiment of the present invention, carrier particles of relatively constant conductivities from between about $10^{-15}$ mho-cm$^{-1}$ to from about $10^{-9}$ mho-cm$^{-1}$ at, for example, a 10 volt potential across a 0.1 inch gap containing carrier beads held in place by a magnet; and wherein the carrier particles are of a triboelectric charging value of from −15 microcoulombs per gram to −70 microcoulombs per gram, these parameters being dependent on the coatings selected, and the percentage of each of the polymers used as indicated hereinbefore. Following application of the polymer mixture, heating is initiated to permit evaporation of the solvent present. The concentration of the coating material particles may be selected to enable the formation of a continuous film of the coating material on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-9}$ to about $10^{-17}$ mho-cm$^{-1}$ as measured, for example, across a 0.1 inch magnetic brush at an applied potential of 10 volts, and wherein the coating coverage encompasses from about 10 percent to about 100 percent of the carrier core.

Illustrative examples of finely divided toner resins selected for the developer compositions of the present invention include polyamides, epoxies, polyurethanes, diolefins, styrene acrylates, styrene methacrylates, styrene butadienes, crosslinked toner resins, vinyl resins, polymeric esterification products of a dicarboxylic acid and a diol comprising a diphenol and the like. Specific vinyl monomers that can be used, which monomers are polymerized, are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether, vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; mixtures thereof; and other similar components.

As one toner resin there can be selected the esterification products of a dicarboxylic acid and a diol comprising a diphenol, reference U.S. Pat. No. 3,590,000 the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethylterephthalate, 1,3-butanediol, 1,2-propanediol and pentaerythritol; PLIOLITES ® available from Goodyear Chemical Company, PLIOTONES ® available from Goodyear Chemical Company, styrene acrylates crosslinked with, for example, divinylbenzene; styrene methacrylates crosslinked with, for example, divinylbenzene; and the like.

Generally, from about 1 part to about 5 parts by weight of toner particles are mixed in a suitable mixing apparatus such as a Munsen mixer with from about 100 to about 300 parts by weight of the carrier particles prepared in accordance with the process of the present invention.

Numerous well known suitable pigments or dyes can be selected as the colorant for the toner particles including, for example, carbon black, such as REGAL ® 330, nigrosine dye, lamp black, iron oxides, magnetites, and mixtures thereof. The pigment, which is preferably carbon black, should be present in a sufficient amount to render the toner composition highly colored. The pigment particles can thus be present in effective amounts of, for example, from about 2 percent by weight to about 20 percent by weight, and preferably from about 3 percent by weight to about 11 percent by weight based on the total weight of the toner composition, however, lesser or greater amounts of pigment particles may be selected.

When the pigment particles are comprised of magnetites, which are comprised of a mixture of iron oxides ($FeO.Fe_2O_3$) including those commercially available as MAPICO BLACK ®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin material is selected. Generally, however, providing the objectives of the present invention are achieved, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner compositions comprised of toner resin particles, carrier particles obtained by the solution processes illustrated herein, and as pigments or colorants, magenta, cyan and/or yellow particles, as well as mixtures thereof. More specifically, illustrative examples of magenta materials that may be selected as pigments include 1,9-dimethylsubstituted quinacridone and anthraquinone dye identified in the Color Index as Cl 60720, Cl Dispersed Red 15, a diazo dye identified in the Color Index as Cl 26050, Cl Solvent Red 19, and the like. Examples of cyan materials that may be used as pigments include copper tetra-4-(octaecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are Diarylide Yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Permanent Yellow FGL, and the like. These pigments are generally present in the toner composition in an amount of from about 1 weight percent to about 15 weight percent based on the weight of the toner resin particles.

For enhancing the positive charging characteristics of the developer compositions described herein, and as optional components there can be incorporated in the toner charge enhancing additives inclusive of alkyl pyridinium halides, reference U.S. Pat. No. 4,298,672, the disclosure of which is totally incorporated herein by reference; quaternary ammonium organic sulfate or sulfonate compositions, reference U.S. Pat. No. 4,338,390, the disclosure of which is totally incorporated herein by reference; distearyl dimethyl ammonium sulfate, reference U.S. Pat. No. 4,560,635, the disclosure of which is totally incorporated herein by reference; bisulfates and mixtures of charge additives, reference for example U.S. Pat. Nos. 4,904,762 and 4,937,157, and copending application U.S. Ser. No. 396,497, and other similar known charge enhancing additives. These additives are usually incorporated into the toner in an amount of from about 0.05 percent by weight to about 20 percent by weight, and preferably are present in an amount of from about 1.0 percent by weight to about 5 percent by weight.

The toner composition of the present invention can be prepared by a number of known methods including melt blending the toner resin particles, and pigment particles or colorants in, for example, a Banbury Mill followed by mechanical attrition including classification. Other methods include those well known in the art such as spray drying, melt dispersion, extrusion, dispersion polymerization and suspension polymerization. In one dispersion polymerization method, a solvent dispersion of the resin particles, pigment particles, and additives are spray dried under controlled conditions to result in the desired product. Toner particles are, it is known, usually of an average diameter of from about 10 to about 25 microns. The toner particles formed may also contain thereon surface additives such as colloidal silicas, such a R972 and metal salts of fatty acids such as zinc stearate in effective amounts of, for example, from about 0.1 to about 1 weight percent.

The toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in the '990 patent. Also, there can be selected as photogenerating pigments, squaraine compounds, thiapyrillium materials, and the like. These layered members are conventionally charged negatively thus requiring a positively charged toner. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference.

Images obtained with this developer composition had acceptable solids, excellent halftones and desirable line resolution with acceptable or substantially no background deposits.

One photoreceptor imaging member that may be selected is comprised of an aluminum substrate, a photogenerating layer of trigonal selenium dispersed in polyvinyl carbazole thereover, and a hole transport layer of N,N'-diphenyl-N,N'-bis(3-methylphenyl)[1,1-biphenyl]-4,4'-diamine, 50 percent by weight dispersed in 50 percent by weight of a polycarbonate.

In an embodiment the coating solution is comprised of the polymer coatings at a concentration of from about 5 to about 25 weight percent solids. The first polymer can be present in the solution mixture in an amount of from about 0.05 to about 4.95 percent by weight, and the second polymer can be present in the solution mixture in an amount of from about 4.95 to about 0.05 percent by weight. The solution mixture of polymers can be metered until, for example, the core is fully wetted by a mixture, followed by agitation in, for example, a vibrating tub or fluid bed, followed by drying in an oven by heating at, for example, a temperature of from about 50° to about 150° C., and screened to provide carrier particles with an average particle diameter of from 30 about to about 450 microns. A slurry containing two polymers, one of which is substantially insoluble, may also be selected in an embodiment of the present invention, it is believed.

The following examples are being supplied to further define the present invention, it being noted that these examples are intended to illustrate and not limit the scope of the present invention. Parts and percentages are by weight unless otherwise indicated. Comparative Examples are also presented.

EXAMPLE I

There are prepared coated carrier particles, 0.75 weight percent coating weight as follows. A solution of 119 grams of polymethylacrylate in 850 grams of the solvent methylethylketone is prepared by mixing in a 1,000 milliliter flask. There are placed 15,876 grams of Toniolo atomized steel, 120 microns in average diameter, in a Vibra Tub Mixer. To the mixer is then added the aforementioned prepared solution, and mixing is continued for a period of about 25 minutes, at which tme the carrier steel core is completely wet. Thereafter, the mixture is dried by heating at a temperature of about 60° C. for about 15 minutes, followed by cooling.

A developer composition is then prepared by mixing 97.5 grams of the above prepared carrier particles with 2.5 grams of a toner composition comprised of 88 percent by weight of a styrene n-butylmethacrylate copolymer resin, 58 percent by weight of styrene, 42 percent by weight of n-butylmethacrylate, and 10 percent by weight of carbon black, and 2 percent by weight of the charge additive cetyl pyridinium chloride. Thereafter, the triboelectric charge on the carrier particles is determined by the known Faraday Cage process, or in the known charge spectrograph, reference U.S. Pat. No. 4,375,673, the disclosure of which is totally incorporated herein by reference, and there is measured on the carrier a charge of −12 microcoulombs per gram. Further, the conductivity of the carrier as determined by forming a 0.1 inch long magnetic brush of the carrier particles, and measuring the conductivity by imposing a 10 volt potential across the brush is $10^{-15}$ mho-cm$^{-1}$. Therefore, these carrier particles are insulating.

In all the working examples, the triboelectric charging values and the conductivity numbers are obtained in accordance with the aforementioned procedure.

EXAMPLE II

The procedure of Example I is repeated with the exception that 32 grams of polymethylmethacrylate, and 850 milliliters of methylketone are utilized resulting in carrier particles with a 0.2 weight percent coating. There results on the carrier particles a triboelectric charge thereon of −9 microcoulombs per gram. Also, the carrier particles have a conductivity of $10^{-9}$ mho-cm$^{-1}$. Thus, these particles are considered conductive.

EXAMPLE III

A developer composition of the present invention is prepared by repeating the procedure of Example I with the exception that there is selected for the solution 12 grams of polyvinylidene fluroide, 107 grams of polymethylmethacrylate, and 1,000 milliliters of methyl ethyl ketone solvent. There results carrier particles with a steel core containing a coating of 0.75 weight percent (ratio of polymers 1:9). There results on the carrier particles a triboelectric charge of −18 microcoulombs per gram. Also, the carrier particles are insulating in that they had a conductivity of $10^{-15}$ mho-cm$^{-1}$.

EXAMPLE IV

A developer composition is prepared by repeating the procedure of Example III with the exception that there is selected as the carrier coating of a polymer mixture, ratio 9:1, of 107 grams polyvinylidene fluoride, KYNAR® 301F, and 12 grams of polymethylmethacrylate in 1,200 milliliters of methyl ethyl ketone solvent. There results on the carrier particles a triboelectric charge of −58 microcoulombs per gram, and the insulating carrier particles has a conductivity of $10^{-15}$ mho−cm$^{-1}$. The coating weight is 0.75 weight percent.

EXAMPLE V

A developer composition was prepared by repeating the procedure of Example III with the exception that there was selected as the carrier coating a blend, ratio 3:2, of a polymer mixture of 71 grams of polyvinylidene fluoride, KYNAR® 301F, and 48 grams of polymethylmethacrylate. There resulted on the carrier particles a triboelectric charge of −31 microcoulombs per gram. Also, the resulting insulating carrier particles had a conductivity of $10^{-14}$ mho-cm$^{-14}$. The coating weight was 0.75 weight percent.

EXAMPLE VI

A developer composition was prepared by repeating the procedure of Example III with the exception that there was selected as the carrier coating a blend, ratio 7:3, of a polymer mixture of polymethylmethacrylate, 36 grams, and 83 grams of polyvinylidene fluoride. There resulted on the carrier particles a triboelectric charge of −48 microcoulombs per gram. Also, the resulting insulating carrier particles had a conductivity of $10^{-14}$ mho-cm$^{-1}$. The coating weight was 0.75 weight percent.

EXAMPLE VII

A developer composition was prepared by repeating the procedure of Example VI with the exception that there was selected as the carrier coating a blend, ratio 7:3, of a polymer mixture of 83 grams of trifluorochloroethylene/vinylchloride copolymer obtained from Occidential Chemical Company as OXY 461, and 36 grams of polymethylacrylate in 1,000 milliliters of solvent. There resulted on the carrier particles a triboelectric charge of −38 microcoulombs per gram. Also, the resulting insulating carrier particles had a conductivity of $10^{-15}$ mho-cm$^{-1}$.

EXAMPLE VIII

A developer composition was prepared by repeating the procedure of Example VII with the exception that there were selected 36 grams of methyl terpolymer in place of the polymethylmethacrylate. There resulted on the carrier particles a triboelectric charge of −28 microcoulombs per gram. Also, the resulting insulating carrier particles had a conductivity of $10^{-15}$ mho-cm$^{-1}$.

Other modifications of the present invention may occur to those skilled in the art based upon a reading of the present disclosure and these modifications are intended to be included within the scope of the present invention.

What is claimed is:

1. A process for the preparation of carrier particles with substantially stable conductivity parameters which comprises providing a carrier core and applying thereto from a solution mixture thereof a mixture of two polymers not in close proximity thereto in the triboelectric series, wherein the polymers are selected from the group consisting of polystyrene, polymethylstyrene, polyvinylbutyral, polyvinylchloride, polyvinylidene fluoride, polytetrafluoroethylene, polytrichlorofluoroethylene, polyesters, polyurethanes, polysulfides, polymethylmethacrylate, copolyethylenevinylacetate, copolyvinylidenefluoride, tetrafluoroethylene, polyethylene, polymethylmethacrylate, copolyethylene vinylacetate, polymethylmethacrylate and polyvinylidene fluoride.

2. A process in accordance with claim 1 wherein the coating is accomplished with heating.

3. A process in accordance with claim 2 wherein the heating is accomplished at a temperature of from about 50° to about 150° C.

4. A process in accordance with claim 2 wherein cooling is effected subsequent to heating.

5. A process in accordance with claim 1 wherein the carrier core is selected from the group consisting of iron and ferrites.

6. A process in accordance with claim 1 wherein the polymer mixture selected is comprised of from about 1 percent by weight to about 99 percent by weight of a first polymer, and from about 99 percent by weight to about 1 percent by weight of a second polymer.

7. A process in accordance with claim 1 wherein the resulting carrier particles are of a conductivity of from about $10^{-6}$ mho-cm$^{-1}$ to about $10^{-17}$ mho-cm$^{-1}$.

8. A process in accordance with claim 1 wherein the coating mixture is comprised of a first and second polymer selected from the group consisting of polystyrene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate.

9. A process in accordance with claim 1 wherein the coating is comprised of two polymers selected from the group consisting of polypropylene, polyethylene, halogenated polyolefins, chlorinated polyethylene, chlorosulfonated polyethylene, and polyvinylidenes.

10. A process in accordance with claim 1 wherein there are selected a first and a second polymer that are at different electronic work function values and wherein the first and second polymers are comprised of different components.

11. A process in accordance with claim 10 wherein an electronic work function value between the first and second polymers is 0.2 electron volt.

12. A process in accordance with claim 11 wherein the difference in electronic work function value between the first and second polymers is about 2 electron volts.

13. A process in accordance with claim 1 wherein there is selected as a first polymer polyvinylidene fluoride and as the second polymer polymethylmethacrylate at a coating weight of 0.75 weight percent and wherein the ratio of the first and second polymer are from about 1:9 and there results carrier particles with a conductivity of $10^{-15}$ mho-cm$^{-1}$ and a triboelectric charge of $-18$ microcoulombs per gram.

14. A process for the preparation of carrier particles which comprises coating a carrier core and applying thereto from a solution mixture thereof comprised of a solvent and a mixture of two polymers not in close proximity in the triboelectric series and wherein one polymer is soluble in said solvent, and wherein the triboelectric charging properties of the carrier are independent of the conductivities thereof, said triboelectric properties being dependent on the ratio of polymers present and said conductivity being dependent on the coating weight of the polymers selected, and wherein the coating thereof is accomplished by heating at a temperature from about 50° to 150° C. followed by cooling thereof.

15. A process in accordance with claim 14 wherein coating is effected in a fluid bed coater.

16. A process in accordance with claim 14 wherein the solution mixture is agitated by stirring.

17. A process in accordance with claim 14 wherein the solution contains from about 5 to about 25 weight percent of polymers.

18. A process in accordance with claim 14 wherein the solution contains from about 10 to about 15 weight percent of polymers.

19. A process in accordance with claim 14 wherein the solvent is an organic liquid.

20. A process in accordance with claim 14 wherein the solvent is acetone, methylethyl ketone, or toluene.

21. A process in accordance with claim 14 wherein the carrier core is steel.

22. A process in accordance with claim 14 wherein the carrier core is selected from the group consisting of iron and ferrites.

23. A process in accordance with claim 14 wherein the polymer mixture selected is comprised of from about 40 percent by weight to about 60 percent by weight of a first polymer, and from about 60 percent by weight to about 40 percent by weight of a second polymer.

24. A process in accordance with claim 14 wherein the resulting carrier particles are of a conductivity of from about $10^{-6}$ mho-cm$^{-1}$ to about $10^{-17}$ mho-cm$^{-1}$.

25. A process in accordance with claim 14 wherein the triboelectric charging value of the resulting carrier particles is from about a positive or negative 5 microcoulombs per gram to about 80 microcoulombs per gram.

26. A process in accordance with claim 14 wherein the coating is continuous, and is present in a thickness of from about 0.2 micron to about 1.5 microns.

27. A process in accordance with claim 14 wherein the carrier core particles have an average particle diameter of between about 30 microns and about 450 microns.

28. A process in accordance with claim 14 wherein the coating mixture is comprised of a first and second polymer selected from the group consisting of polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate.

29. A process in accordance with claim 14 wherein the coating is comprised of a polymer pair selected from the group consisting of polymethylmethacrylate and copolyethylenevinylacetate; copolyvinylidenefluoride tetrafluoroethylene and polyethylene; polymethylmethacrylate and copolyethylene vinylacetate; and polymethylmethacrylate and polyvinylidene fluoride.

* * * * *